US005791029A

United States Patent [19]

Maker

[11] Patent Number: 5,791,029

[45] Date of Patent: Aug. 11, 1998

[54] BLANKET CONSTRUCTION FOR A COMPRESSIVE SHRINKAGE APPARATUS

[75] Inventor: Lewis William Maker, Charlotte, N.C.

[73] Assignee: United States Supply Company, Inc., Charlotte, N.C.

[21] Appl. No.: 868,885

[22] Filed: Jun. 4, 1997

[51] Int. Cl.[6] ..... D06C 21/00

[52] U.S. Cl. ..... 26/18.6; 198/845

[58] Field of Search ..... 26/18.6, 18.5, 26/69 A; 28/116, 132, 134; 198/844.1, 845, 846, 847, 820; 305/165; 474/167, 191, 271, 252, 265; 162/361, 205, 206, 358.3; 226/172

[56] References Cited

U.S. PATENT DOCUMENTS

| | | | |
|---|---|---|---|
| 499,472 | 6/1893 | Robins, Jr. . | |
| 913,917 | 3/1909 | Robins | 198/847 |
| 1,855,808 | 4/1932 | Schwan . | |
| 2,146,694 | 2/1939 | Wrigley et al. . | |
| 2,575,845 | 11/1951 | Singer . | |
| 3,011,545 | 12/1961 | Welsh et al. . | |
| 3,269,893 | 8/1966 | Rojecki . | |
| 3,469,292 | 9/1969 | Hojyo . | |
| 3,570,085 | 3/1971 | Heinemann | 26/18.6 |
| 3,666,085 | 5/1972 | Folkes . | |
| 3,866,277 | 2/1975 | Hojyo | 26/18.6 |
| 4,034,617 | 7/1977 | Guyer | 198/844 |
| 4,088,731 | 5/1978 | Groome | 26/18.6 |
| 4,156,955 | 6/1979 | Joy | 26/18.6 |
| 4,280,620 | 7/1981 | Baker, Jr. | 198/847 |
| 4,819,791 | 4/1989 | Melander | 198/847 |
| 4,955,114 | 9/1990 | Bertoldo | 26/18.6 |
| 5,233,733 | 8/1993 | Rich et al. | 26/18.6 |

*Primary Examiner*—Amy B. Vanatta
*Attorney, Agent, or Firm*—Bell Seltzer Intellectual Property Law Group of Alston & Bird, LLP

[57] ABSTRACT

A construction for a rubber blanket for use on a fabric compressive shrinkage apparatus is described. The blanket includes an inner bearing surface defining a bearing face and an outer surface defining a working face, with the edges of the belt along the bearing surface being beveled so that the bearing face is relatively narrower than the overall belt width. The specially-configured edge construction reduces the tendency of the edges of the blanket to curve upwardly when the blanket is properly tensioned for operation of the apparatus, and the tendency of water to be flung around the edges of the belt and onto the working face is reduced. Further, the beveled side edges promote longer blanket life by reducing the tendency for the edges to crack. Also as a result of the edge construction, a larger effective working face of the blanket can be attained, thereby enabling larger widths of fabric to be processed on the apparatus than previously achievable with outer surface-beveled blankets.

14 Claims, 2 Drawing Sheets

FABRIC ENTRY
FABRIC DELIVERY
DRYING CYLINDER
COOLING DRUM
STEAM CYLINDER
10
12
14
14a
14b
16
18
20
22
24
26
28
30
31
32
34
36
38
B
Bw
BT
T
C
L
W0
Ww
F

BLANKET CONSTRUCTION FOR A COMPRESSIVE SHRINKAGE APPARATUS

BACKGROUND OF THE INVENTION

1. Field of the Invention

The invention generally relates to a blanket construction for use on apparatus used in the compressive shrinkage of textile fabrics.

2. Description of the Prior Art

Many textile fabrics, and in particular those made wholly or partly from cellulosic fibers, have a tendency to shrink undesirably as a result of becoming wet or undergoing conventional laundering processes. To obviate undesirable shrinking, many such fabrics are customarily pre-treated using a compressive or compaction shrinkage process, in order to pre-shrink the fabrics and increase their stability. Examples of compressive shrinkage processes are described in U.S. Pat. No. 2,146,694 to Wrigley, et al. and U.S. Pat. No. 3,469,292 to Hojyo and a popular process is known by the tradename SANFORIZE.

In compressive shrinkage processes, fabric is typically laid out over the working face of a thick endless rubber blanket so that it is free of folds or wrinkles. The rubber blanket is positioned on a plurality of rotatable rolls which support the blanket along its bearing surface, and the blanket is typically conveyed along an endless path by way of a driven cylinder which contacts the outer blanket surface. In this way, fabric placed on the outer surface of the blanket is caused to be carried through a number of processing stations.

First, the fabric is typically moistened, then it is compressed along with the blanket between a roll and a heated cylinder or shoe. As the fabric and blanket pass between the nip (i.e., the point of contact between the two contiguous elements) and the blanket is compressed, adjacent portions of the outer surface of the blanket are caused to be extended. As the blanket and fabric leave the roll, the blanket contracts, and the fabric is forced to follow suit. As a result, the yarns in the warp direction are caused to shorten, and the filling yarns are pushed upwardly, thereby mechanically shrinking the fabric. The fabric is then fed to a dryer, where it is dried in its pre-shrunk condition.

Because the rubber blanket is endless, great lengths of fabric can be processed in a continuous manner. However, the sections of the rubber blanket must be cooled following their contact with the heated cylinder before they can receive a new section of untreated fabric. Such cooling is generally performed by applying water to the blanket as it travels between the point of fabric removal and the point of untreated fabric lay-down. Because too much moisture on the blanket can interfere with proper fabric conditioning, it is generally necessary that the amount of water on the blanket working surface be closely controlled. Generally this is performed by water removal rolls, which squeegee the excess water from the cooled blanket. Because it is important that the blanket stay properly lubricated, water is often added to the bearing surface of the blanket at various positions throughout the process, e.g., before the point of fabric lay-down and following contact of the blanket with the heated cylinder.

As should be apparent, the rubber blankets are exposed to great stresses during the compression shrinkage process as a result of the repeated heating and cooling, the tensions at which the blanket must be run on the machine, the compression forces endured by going through the nip, and the repeated wetting operations. As a result, the blankets have a tendency to crack along the edges, which considerably shortens the blanket life and can interfere with proper machine operation and fabric finishing.

To combat this problem of blanket edge cracking, around 1970, at least one company began to bevel the edges along the outer surface of the blanket (i.e., the surface on which the fabric is treated). Although the bevels were largely effective in reducing the cracking tendency of the blanket edges, they tend to be somewhat undesirable in that the bevels reduce the dimension of the working face of the blanket. Typically, rubber blankets have about a 13' inside circumference and a width ranging from about 68" to 126". Of this width, the bevel usually accounts for approximately ½ to 1½ inches of the width along each blanket side. Because fabric cannot be properly treated along this portion, the bevel can result in loss of up to 3" or more of the width of the working face of the blanket.

In addition, when a rubber blanket is positioned on the compressive shrinkage machinery with the correct amount of tension, the blanket edges have a tendency to curve upwardly. Not only does this increase blanket wear, but the fact that the edges are not planar with the rest of the blanket can mean that fabric processed close to the blanket edge can have a different appearance from that of the other regions.

Further, during the shrinkage process, water has a tendency to be flung around the blanket edges, where it can splash onto to the fabric being treated. It has been found that the outer surface bevels tend to encourage the transmission of undesirable water to central portions of the outer surface of the blanket, which is undesirable from a fabric quality perspective. Because such water can damage the fabric and cause processing irregularities, rubber blanket manufacturers generally recommend that the working face of the blanket to be used be at least 6–8 inches wider than the fabric to be treated thereon. Thus, where a 1½ inch bevel is provided along each side, it commonly results that the blanket is required to be at least 9 inches wider than the fabric which is to be treated thereon. Obviously, a loss of efficiency with respect to the amount of fabric that can be treated is realized by virtue of the blanket being required to be so much wider than the fabric which it is used to treat. Further, the machinery which is required to treat a given width of fabric is also necessarily larger than would be desirable and maximally efficient.

In addition, oils and/or re-wetting solutions are generally applied to the fabric prior to the shrinkage operation in order to assist with the water's penetration into the fabric, increase lubricity, and help move the filling yarns of the fabric closer together. Such oils and re-wetters, as well as many fabric finishes, tend to have a softening effect on the rubber, causing the rubber to revert back to a gum state and form dead rubber on the blanket surface. The formation of dead rubber is also encouraged by the high temperatures of the heated cylinder. As a result, users of compressive shrinkage apparatus must test blanket hardness frequently (e.g., by durometer testing for Shore A hardness or the like) in order to ensure that proper hardness is maintained and that too much dead rubber has not built up on the working surface.

Once the blanket hardness has been found to deviate upwardly or downwardly about 12% from its original level, blanket manufacturers recommend that the blanket be ground to remove the dead rubber on its surface. In this way, the surface of the blanket is prevented from becoming too slick and from losing its ability to grab hold of the fabric being treated. Such grinding is usually performed by backing the rubber blanket against a rotatable roll covered with abrasive material (e.g., grinding cloth or abrasive fabric), which grinds the working face of the rubber blanket until the dead rubber area has been removed. Typically this requires removing about a sixteenth of an inch of the rubber surface with each grinding. Because, for example, a blanket which begins at 2⅝ inches thick usually must remain at least two inches thick to work effectively, the number of grindings is thus very limited. As a result, the life of the rubber blanket can be undesirably short.

As noted above, when the proper tension is applied to the rubber blanket during machine operation, the edges of the blanket tend to curl upwardly. During the grinding process, the tension on the blanket must be increased above the optimum working tension level, in order to flatten the ends out so that the blanket surface can be ground evenly. Often times, however, the technicians doing the grinding forget to re-set the original tension on the blanket following the completion of the grinding process, and fabric processed thereafter is treated under less than optimal conditions. Not only does this reduce the effectiveness of the shrinkage process, but the effective life of the blanket is also reduced. Furthermore, the amount of bevel is reduced with each grinding since a layer of the central portion of the outer surface (i.e., a layer of the working face) is removed with each grinding operation.

In addition, conventional blankets typically include a slight radius along the corners of each of their edges; the radius rounds out the sharp edges, which helps reduce the incidence of blanket edge cracking. Because of the difficulty perceived by the machine operators in reapplying the radius to the angled outermost corners of the working face formed by the grinding operation, many operators are lax about reapplying the radius to the angled corner, which can reduce the quality and safety of the blanket.

Despite these negatives, however, compressive shrinkage blankets continue to be made with side edges beveled along their outer surface to this day, since heretofore no functionally superior product has been available.

Thus, a need exists for a rubber blanket construction for use in compressive shrinkage apparatus which has a reduced tendency to curl at the edges and which has an increased life-span.

SUMMARY OF THE INVENTION

These and other needs are met through the provision of a rubber blanket having beveled edges along the inner surface (i.e., the surface of the endless rubber blanket which bears against the rolls.) Surprisingly, it has been found that by beveling the side edges of the blanket along the inner surface, many of the negatives typically associated with the outer surface bevels are obviated, while the advantages of a beveled edge construction are still attained. For example, when the blanket is properly tensioned on the machinery, the edges have less of a tendency to curl upwards than with the outer surface beveled or unbeveled prior art blanket constructions. Not only does this reduce the stresses along the blanket edges, but the blanket does not require the large amount of over-tensioning to flatten it out for grinding. In addition, water has less of a tendency to be flung onto the working face of the blanket than with the prior outer surface bevel construction, which means that a greater width of the working face of the blanket can be utilized. Further, the bevels on the inner surface of the blanket remain constant despite repeated grinding operations, thereby increasing the effectiveness of the bevels and correspondingly, the life of the blanket.

In embodiments of the invention having beveled edges only along the inner surface of the blanket, the width of the working face is increased to the entire width of the blanket, which means that larger widths of fabric can be treated. This is of particular importance in that commercially popular fabrics have in recent times been produced at greater widths, which would otherwise require wider processing apparatus. Further, since in these embodiments an unbeveled outer surface is utilized, the provision of radii to the right-angled corners along the outer surface can be performed easily by the operator following grinding.

In alternative embodiments utilizing bevels on both the outer and inner blanket structure, good resistance against edge cracking is achieved while the disadvantage of edge curling is minimized.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figures 1, 2, 3:
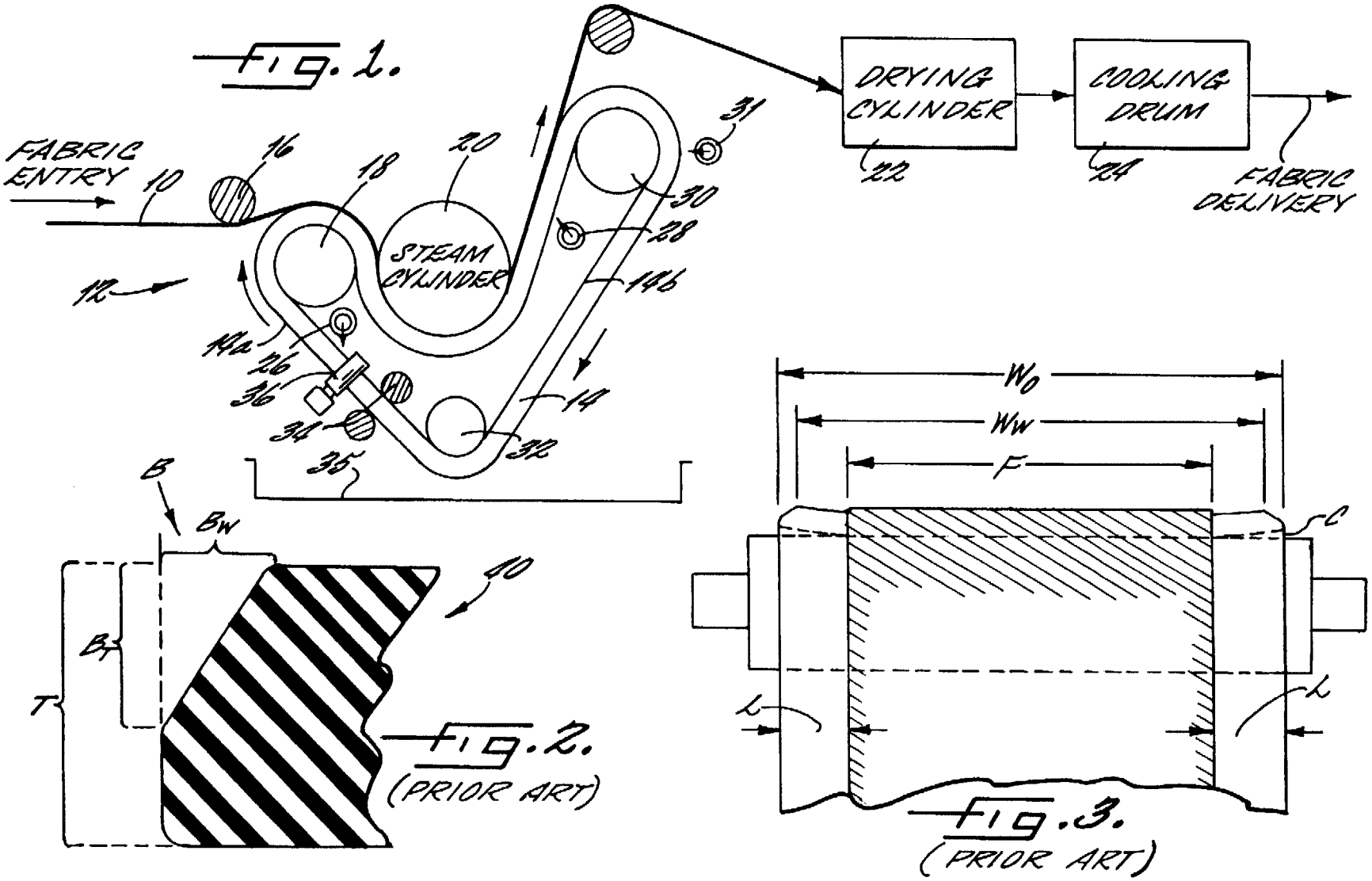
FIG. 2. (PRIOR ART)
FIG. 3. (PRIOR ART)
FIG. 1 is a schematic representation of a conventional compressive shrinkage operation.
FIG. 2 is a partial cross-sectional view of a prior art rubber blanket edge construction.
FIG. 3 is a cut-away plan view of a prior art blanket such as that shown in FIG. 2, as it appears when positioned around a roll and properly tensioned for machine operation.

FIG. 1 is schematic representation of a conventional compressive shrinkage process utilizing a Morrison-type compressive shrinkage machine. This arrangement can be used in combination with prior art blanket constructions as well as with the construction of the instant invention. A length of fabric 10 is advanced to the shrinkage machine, shown generally at 12, so that the fabric extends along a working face 14*a* of a rubber blanket 14. Tension is applied such as by roll 16, so that the fabric 10 extends smoothly along the working face 14*a* of the rubber blanket, and is substantially free of wrinkles. As illustrated, the rubber blanket 14 extends around a pressure roll 18 and is in turn compressed between the pressure roll and a heated cylinder 20 which applies heat to the fabric. In a preferred form of the invention, the heated cylinder 20 is heated by steam. In the manner described above with respect to conventional compressive shrinkage apparatus, the outer surface of the rubber blanket 14 is extended during the process, so that as the blanket and fabric leave the roll 18, the blanket contracts and the fabric 10 is forced to follow suit. The fabric 10 is then removed from the blanket and fed to a dryer 22 such as a Palmer drying cylinder, then desirably to a cooling drum 24. The fabric 10 is then desirably advanced to either a further processing stage or to a take-up mechanism.

As illustrated, water is optionally applied to the bearing surface 14b of the blanket at positions 26 and 28, i.e., preceding the pressure roll 18 and immediately following the steam cylinder 20, in order to keep the rubber blanket 14 lubricated, and to assist in cooling it in preparation for the laying-down of untreated fabric. The blanket 14 then desirably continues around the tension roll 30 and a bottom idler roll 32 and, because it is in the form of an endless loop, returns back to its original position proximate the pressure roll 18. As shown at 31, water is also desirably sprayed on the working face 14a of the blanket proximate the tension roll 30, i.e., downstream of the position where the fabric is removed from the blanket, in order to cool the working face of the rubber blanket 14. Because it is important to control the amount of water on the outer surface of the blanket, water removal rolls 34 are preferably provided to remove water prior to the introduction of the fabric 10, with such water being collected by a pan 35. Water is then desirably added to the bearing face of the blanket, such as illustrated at 26 and 28, to keep the blanket properly lubricated.

In addition, a blanket which is not precisely aligned on the rolls or the processing of a fabric which is unevenly tensioned or skewed will have a tendency to cause the blanket to move sideways along the rolls, where it can potentially work its way off the machine. To prevent the blanket from working its way off of the machine, lateral stop rolls 36 are usually provided along opposite sides of the rubber blanket 14 to act as side bumpers, thereby assisting in maintaining the blanket on the rolls. However, continued contact between the blanket edges and the stop rolls can further reduce the blanket life by encouraging blanket edge cracking. For this reason, blanket manufacturers generally recommend that the width of blanket which is used on a machine be narrower than the distance between the two lateral stop rolls. However, because the widths of fabric to be processed often require a maximized blanket working face for a given machine, processors often use blankets which continually contact both of the lateral stop rolls during processing, in order to maximize the width of working face which is available, despite the negative effects on blanket life.

FIG. 2 shows a prior art rubber blanket construction 40 having an outer surface bevel. As illustrated, the blanket 40 has an overall thickness T which is generally about two to three inches on a blanket having an inside circumference of about 13 feet. Each of the side edges of the outer blanket surface is beveled to form a bevel B which defines a bevel width Bw (i.e., the distance between the inwardmost point of the bevel to an imaginary line drawn upwardly from the blanket edge) and a bevel thickness Bt (i.e., the distance into which the bevel B extends into the blanket thickness T.) (For purposes of this application, the term "bevel" is meant to include slanted or inclined surfaces which can be of a variety of shapes, including but not limited to planar, rounded, mixed geometric, and irregularly shaped.) In a typical blanket construction, the blanket thickness T is about 2 to 3 inches, with the bevel width generally being from about ½" to 1½" on each side of the blanket, the bevel thickness being from about one-half to two thirds of the blanket thickness T, and the bevel sloping at an angle of about 45°. As shown in FIG. 3, this results in a blanket which has an overall blanket width Wo, and a working face width Ww equal to the overall blanket width minus the bevel width Bw on each side. As discussed above, the width of fabric F which can be effectively processed on a blanket working face of a given width is less than the width of the working face.

Because of the tendency of such prior art blankets to curve upwardly at the edges when properly tensioned on the machinery (as shown, for example, in FIG. 3 at C) and the tendency of water to be flung around the edges of the blanket, manufacturers generally recommend that margins L of at least about three to four inches of blanket working face be left on either side of the fabric F being processed. For example, with a conventional 72 inch wide blanket having an inch-wide bevel along each side edge of the outer blanket surface, a manufacturer would typically recommend that fabric widths no larger than 64" be processed. Thus a great deal of the blanket outer surface goes unused and it is required that machinery be much larger than would be optimal in order to produce a given width of fabric.

Figure 4:
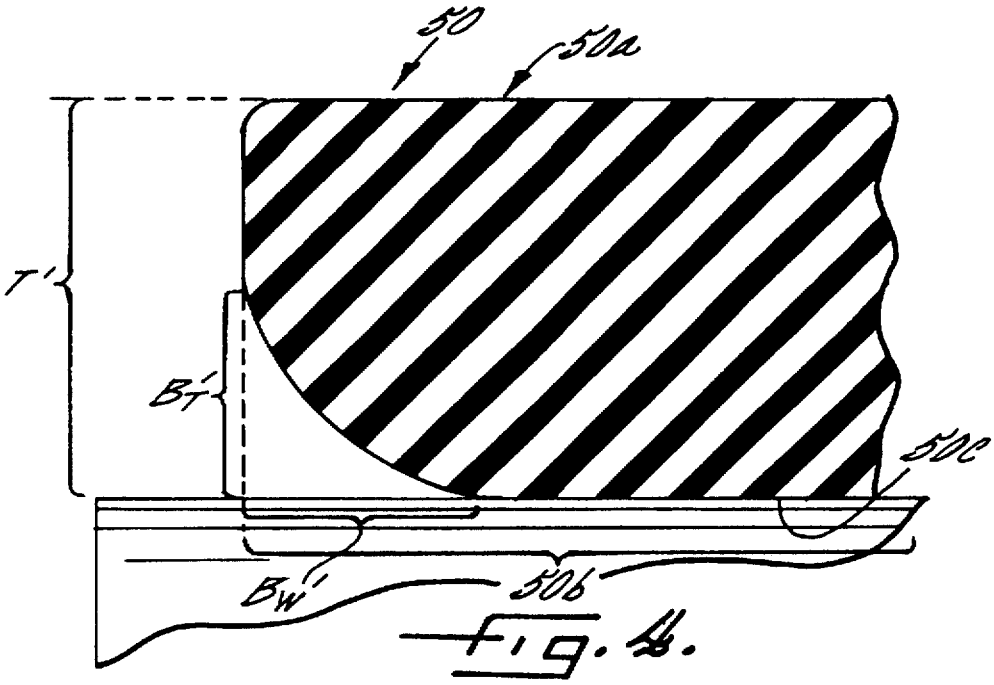
FIG. 4 is a partial cross-sectional view of a rubber blanket edge construction according to the instant invention.
Figure 5:
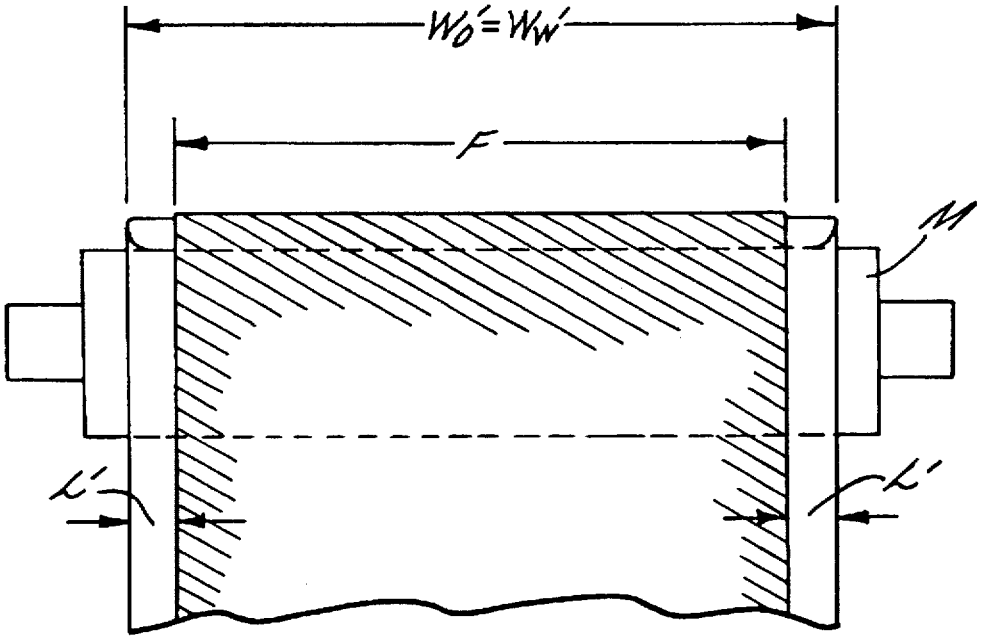
FIG. 5 is a plan view of a blanket according to the instant invention as it appears when extending around a roll on a compressive shrinkage apparatus.

FIGS. 4 and 5 illustrate a blanket construction according to the instant invention. The blanket 50 is in the form of an endless rubber belt and includes an outer surface 50a, an inner surface 50b defining a bearing surface 50c which is adapted to contact a plurality of rotatable rolls. The blanket has an overall thickness T', which can be selected according to the machinery on which it will be utilized as well as the fabric F which it will be used to process. In a preferred embodiment of the invention, the overall blanket thickness T' is about 2–3 inches, and preferably about 2⅝ to 2¾ inches. The blanket 50 includes a bevel B' along each of the side edges, each of which defines a bevel width Bw' (i.e., the distance between the inwardmost point of the bevel to an imaginary line drawn downwardly from the blanket outer edge) and a bevel thickness Bt' (i.e., the distance into which the bevel extends into the overall blanket thickness T'.) Although the bevel is illustrated as being rounded in FIG. 4, it is noted that other bevel shapes can be utilized within the scope of the instant invention, including, but not limited to, planar bevels (such as that shown in FIG. 2) and those of mixed geometric or irregular shape. For example, the inner surface 50b can be beveled gradually at each side edge of the belt to define first and second substantially planar bevels; in a preferred form of this embodiment, each of the bevels extends at substantially a 45° angle relative to the bearing face of the belt.

In the illustrated embodiment, the bevel thickness Bt' is slightly over one-half of the overall blanket thickness T'. While this thickness ratio has been found to be useful, it is to be noted that other ratios and bevel angle slopes are anticipated within the scope of the instant invention. Similarly, while the bevel width Bw' is illustrated as being approximately equal to the bevel thickness Bt', it is to be noted that various dimensions of bevel width and ratios of bevel width to thickness are anticipated according to this invention.

As discussed above, by providing the bevels B on the inner surface of the blanket 50, a blanket having a reduced propensity for edge cracking can be achieved, without the corresponding reduction in working face dimension and tendency to transfer water associated with the prior outer surface beveled blanket constructions 40. In addition, and as illustrated in FIG. 5, the edges 52 of the blanket 50 do not tend to curve upwards when the blanket is properly tensioned for operation on the machine M, unlike those of the prior outer surface beveled blanket constructions 40. In addition, when the bevels are provided only on the inner surface 50b and the outer surface 50a is substantially unbeveled, a working face dimension Ww can be achieved which equals the overall width Wo of the blanket itself. As a result, greater widths of fabric F can be processed thereon than with prior art blanket constructions, and more efficient processing can be achieved.

Further, because the blankets according to the present invention have been found to have less of a tendency to transfer water undesirably to the working face of the blanket, the safety margins L' along the blanket edges can be reduced from those required during the use of conventional blankets. For example, in a 72 inch conventional blanket with one inch bevels along the side edges of the outer blanket surface, a manufacturer would typically recommend that fabrics no wider than 64 inches be processed thereon, in order to account for the reduction in working face caused by the provision of the bevels, and to leave 3 inch working face margins along each side of the fabric. In contrast, because the working face of a similarly sized blanket made according to certain embodiments of the instant invention is the full 72 inch width of the blanket and undesirable water transfer is reduced, fabrics as wide as 68 inches or greater can be processed on a 72 inch wide blanket having one inch bevels on the inner surface.

In an alternative embodiment of the invention (not shown), bevels are provided along the side edges of both the outer and inner surfaces of the blanket; again, the bevels can be of any angle, shape or dimension, though care must be taken that the edges of the blanket are not caused to be too thin as a result of being beveled along both outer and inner blanket surfaces. While this embodiment does not provide the advantage of the working face being equal to the overall blanket width, the tendency for the blanket edges to curl up is reduced. As a result, undesirable water splash is minimized, and a greater dimension of the blanket face can be utilized.

Many modifications and other embodiments of the invention will come to mind to one skilled in the art to which this invention pertains having the benefit of the teachings presented in the foregoing descriptions and the associated drawings. For example, it is contemplated that blankets according to the instant invention can be used in similar apparatus such as those used to calendar substantially all-polyester fabrics, it being recognized that in such instances the introduction of water and use of a dryer may not be necessary. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A rubber blanket construction for use in a compressive shrinkage apparatus comprising:

an endless rubber belt having an outer surface defining a working face, an inner surface defining a bearing face for contacting a plurality of rolls, and first and second side edges defining an overall belt width, wherein said inner surface is beveled along said first and second side edges to define a bearing face which is relatively narrower than said overall belt width.

2. A blanket construction according to claim 1, wherein said inner surface is beveled gradually at each side edge of the belt at a constant slope, to define first and second substantially planar bevels along the respective first and second side edges of the belt.

3. A blanket construction according to claim 2, wherein each of said substantially planar bevels extends at substantially a 45° angle relative to the bearing face of the belt.

4. A blanket construction according to claim 1, wherein said inner surface is beveled at each side edge of the belt along a curved path to define first and second rounded bevels along the respective first and second side edges of the belt.

5. A blanket construction according to claim 1, wherein said outer surface of the belt is substantially unbeveled to define a working face having substantially the same width as said overall belt width.

6. A blanket construction according to claim 1, wherein said outer surface of the belt is beveled along said first and second side edges, to define a working face which is relatively narrower than said overall belt width.

7. A blanket construction according to claim 6, wherein said outer and inner surfaces are respectively beveled to define a working surface and a bearing surface having substantially the same widthwise dimension.

8. A blanket construction according to claim 1, wherein said outer and inner surfaces define an overall belt thickness therebetween, and the inner surface is beveled along the first and second side edges about ⅓ to ⅔ thirds of the dimension of the overall belt thickness.

9. A blanket construction according to claim 1, wherein said bearing face is approximately one to six inches narrower than said overall belt width.

10. A blanket construction according to claim 9, wherein said endless rubber belt has an inside circumference of about 13 feet, an overall belt width of about 68–126 inches, and an overall belt thickness of about 2–3 inches.

11. A blanket construction for use in compressive shrinkage apparatus comprising:

an endless rubber belt having an outer surface defining a working face for contacting a piece of fabric to be processed, an inner surface defining a bearing face for contacting a plurality of rolls, and first and second side edges defining an overall belt width, wherein said side edges of said belt are tapered inwardly along the inner surface to define a bevel along each side of the belt and a bearing face which is relatively narrower than other portions of the belt.

12. A blanket construction according to claim 11, wherein said overall belt width is from about 68–126 inches and said bearing face has a width which is about one to six inches less than said overall belt width.

13. A compressive shrinkage apparatus for mechanically shrinking lengths of fabric comprising:

a plurality of rotatable rolls arranged in a spaced relationship for carrying an endless rubber blanket;

an endless rubber blanket positioned on said plurality of rolls for conveyance along an endless pathway; said endless rubber blanket comprising an outer surface and an inner surface, and first and second side edges defining an overall belt width, and said inner surface is beveled along said first and second side edges to define a bearing face which is relatively narrower than said overall belt width;

a compression device positioned along said endless pathway for compressing said rubber blanket; and a heating device positioned along said endless pathway proximate said compression device for heating said rubber blanket.

14. An apparatus according to claim 13, wherein said heating device comprises a heated cylinder which is driven to rotate about its axis.

* * * * *